US011474471B2

(12) United States Patent
Johnson et al.

(10) Patent No.: US 11,474,471 B2
(45) Date of Patent: Oct. 18, 2022

(54) FINISHERS TO EJECT JAMMED PRINT MEDIA

(71) Applicant: HEWLETT-PACKARD DEVELOPMENT COMPANY, L.P., Spring, TX (US)

(72) Inventors: Bruce G. Johnson, Vancouver, WA (US); Matthew Douglas Reier, Vancouver, WA (US); Robert Yraceburu, Vancouver, WA (US); Elliott Downing, Vancouver, WA (US); Francisco Javier Gomez Maurer, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/498,761

(22) PCT Filed: Sep. 1, 2017

(86) PCT No.: PCT/US2017/049831
§ 371 (c)(1),
(2) Date: Sep. 27, 2019

(87) PCT Pub. No.: WO2019/045749
PCT Pub. Date: Mar. 7, 2019

(65) Prior Publication Data

US 2021/0096496 A1 Apr. 1, 2021

(51) Int. Cl.
*G03G 15/00* (2006.01)
*B41J 11/00* (2006.01)

(52) U.S. Cl.
CPC ..... *G03G 15/70* (2013.01); *B41J 11/006* (2013.01)

(58) Field of Classification Search
CPC ..... B41J 11/006; G03G 15/70
See application file for complete search history.

(56) References Cited

U.S. PATENT DOCUMENTS 4,606,175 A * 8/1986 De Crane ..... B65B 59/04 156/443
5,479,240 A * 12/1995 Lee ..... G03G 15/70 399/21

(Continued)

FOREIGN PATENT DOCUMENTS

CN 101269588 B 4/2011
CN 102555545 7/2012

(Continued)

OTHER PUBLICATIONS

Bishop, M et al., Analysis of Volume Testing of the AccuVote TSx / AccuView. Oct. 11, 2005.

*Primary Examiner* — David H Banh
(74) *Attorney, Agent, or Firm* — Perry + Currier Inc.

(57) ABSTRACT

A finisher apparatus includes an actuator to control a component of the finisher apparatus to perform a finishing operation on a print medium. A sensor is provided to sense the print medium in a print-medium path in the finisher apparatus. A processor is coupled to the actuator and the sensor. The processor is to execute instructions. The instructions are to actuate the actuator to eject the print medium from the print-medium path in response to a signal from the sensor indicative of a jam of the print medium in the finisher apparatus.

13 Claims, 7 Drawing Sheets

(56) References Cited

U.S. PATENT DOCUMENTS 5,832,358 A 11/1998 Sampath et al.
6,007,062 A 12/1999 Choo et al.
6,353,726 B1 3/2002 Murata et al.
7,934,357 B2 5/2011 Watson
8,696,107 B2 4/2014 Lo et al.
8,861,989 B2 10/2014 Hara et al.
9,272,864 B2 3/2016 Dufort et al.
9,302,505 B2 4/2016 Toia et al.
2004/0245717 A1* 12/2004 Pfankuch ..... B65H 5/16 198/470.1
2004/0247365 A1 12/2004 Lofthus et al.
2005/0141939 A1* 6/2005 Kayama ..... B65H 43/06 399/405
2006/0001723 A1 1/2006 Gordon et al.
2008/0047448 A1 2/2008 Cocklin et al.
2009/0179928 A1* 7/2009 Nemoto ..... B41J 2/16585 347/8
2011/0053742 A1* 3/2011 Wetsch ..... B31D 5/006 493/27
2011/0064428 A1* 3/2011 Hara ..... B41J 11/006 399/21
2012/0027428 A1* 2/2012 Terao ..... B65H 45/18 399/21
2013/0140971 A1* 6/2013 Wu ..... B41J 29/13 312/319.6
2013/0270761 A1* 10/2013 Kimata ..... B41L 43/12 270/58.08
2013/0302045 A1* 11/2013 Serizawa ..... G03G 15/231 399/21
2014/0153978 A1* 6/2014 Ozawa ..... G03G 15/2028 399/322
2014/0175728 A1* 6/2014 Kimura ..... B31F 5/001 270/1.01
2014/0293303 A1* 10/2014 Nakamura ..... G03G 15/6529 358/1.12
2015/0352862 A1* 12/2015 Dufort ..... B65H 5/062 271/3.2
2016/0171294 A1* 6/2016 Pietschker ..... G06K 9/00335 382/137
2016/0221775 A1* 8/2016 Yoshiura ..... G03G 15/6529
2017/0023910 A1* 1/2017 Boyatt, III ..... G03G 21/1685
2017/0087559 A1* 3/2017 Tso ..... B02C 18/2291
2019/0163113 A1* 5/2019 Konishi ..... G03G 15/70

FOREIGN PATENT DOCUMENTS

CN 204054973 U 12/2014
CN 106346958 1/2017
CN 106863807 A 6/2017

* cited by examiner

FINISHERS TO EJECT JAMMED PRINT MEDIA

BACKGROUND

Print media is known to jam even in well designed and maintained printers. A paper jam typically needs to be resolved before an interrupted print job can be completed or a new print job can be started. Damage to printer components may occur if a jam is not properly resolved. Printer uptime may also be negatively affected by jams.

DETAILED DESCRIPTION

Resolving a print-media jam may be a difficult or intimidating task for a user. Clearing such a jam in a finisher may be even more challenging for a user due to a large number of movable components within a relatively limited space inside the finisher. Space within the finisher may be further reduced when the finisher is vertically stacked with the print engine.

Figure 1:
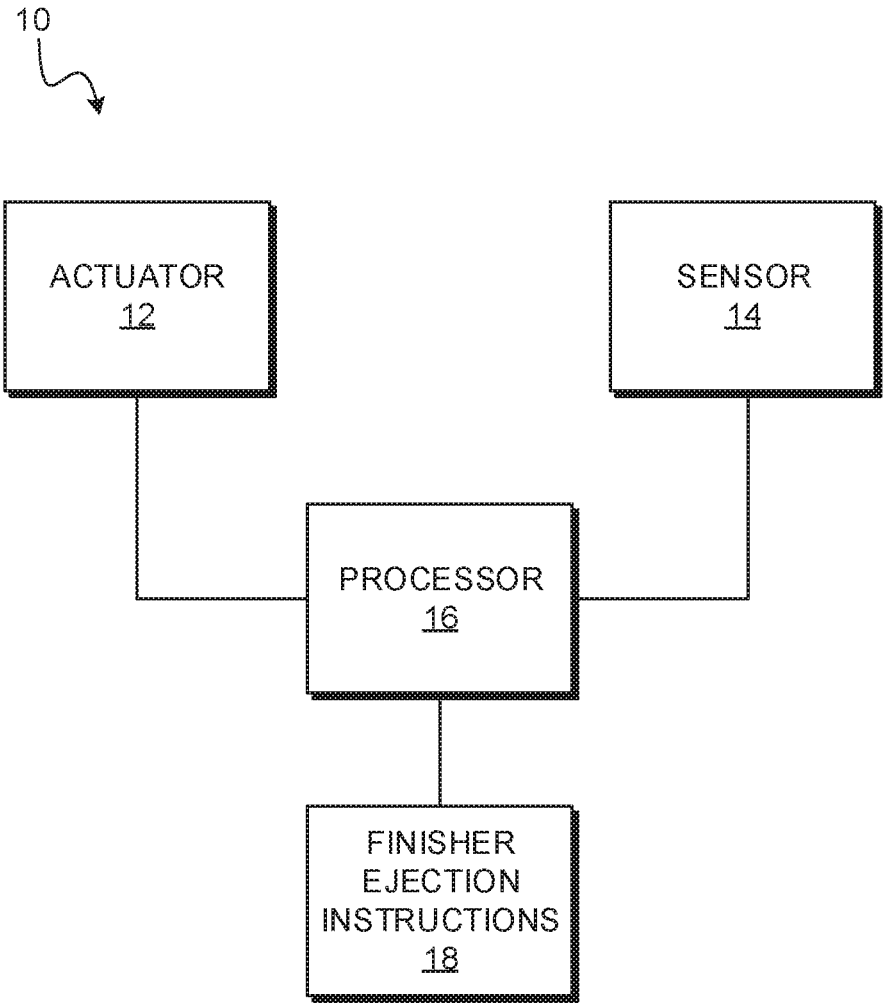
FIG. 1 is a block diagram of an example finisher apparatus.

FIG. 1 shows an example finisher apparatus 10 that allows jammed print media to be ejected or removed. The finisher apparatus 10 may include an actuator 12, a sensor 14, a processor 16, and instructions 18 to eject a print medium that may become jammed in the finisher apparatus 10 from time to time.

The actuator 12 may actuate a component of the finisher apparatus 10 to perform a finishing operation on a print medium, such as a sheet or stack of paper. Other examples of print media include plastic film, card stock, and similar. Examples of finishing operations include stapling, offsetting, collating, binding, stamping, embossing, coating, laminating, cutting, folding, and the like. Examples of actuated components include an edge clamp, a stapler, a puller, and the like. The actuated component may be positioned along a print-medium path through the finisher apparatus 10 to perform a finishing operation. The actuated component may serve to convey print media along the path. The actuated component may physically manipulate the print media. Any number of finishing components and actuators may be provided to perform any number of finishing operations. An actuator may be integrated with a component. Multiple print-medium paths may be provided, and a particular finishing operation or set of finishing operations may use a particular path.

The sensor 14 may be to sense the print medium in the print-medium path and may be used to detect jamming of print media in the finisher apparatus 10. The sensor 14 may be positioned to directly sense the presence or absence of the print medium at a point along the path. The sensor 14 may sense a leading edge, a trailing edge, or both such edges of the print medium. The sensor 14 may be, for example, a switch, a Hall effect sensor, an optical sensor, a photodiode, a reflective sensor, or the like, positioned to sense the contact or proximity of the print medium.

The sensor 14 may be positioned to sense a position, orientation, or other characteristic of an actuator 12 or a component controlled by an actuator 12. Sensing at the actuator 12 or component may allow a jam to be inferred. The sensor 14 may be integrated into a component or an actuator 12.

The processor 16 may be coupled to the actuator 12 and the sensor 14. The processor 16 may include a central processing units (CPU), a microcontroller, a microprocessor, a processing core, a field-programmable gate array (FPGA), or similar device capable of executing instructions. The processor 16 may control operation of the actuator 12 and receive a signal from the sensor 14. The processor 16 may be dedicated to the finisher apparatus 10 or may provide functionality to a printer that includes the finisher apparatus 10.

The instructions 18, which may be termed finisher ejection instructions, are to actuate the actuator 12 to eject jammed print medium from the print-medium path of the finisher apparatus. The instructions 18 may cause automatic ejection of the jammed print medium in response to a signal received from the sensor 14 indicative of a jam at the finisher apparatus 10. The instructions 18 may cause such automatic ejection of jammed print media without user input or user intervention. The instructions 18 may be stored in memory that cooperates with the processor 16.

The instructions 18 may also be to detect jamming of print medium in a finisher apparatus 10. Such detection may be performed based on a signal received from the sensor 14. The signal may be processed alone or with information about the state of a finishing operation or print job to determine whether a jam is indicated. For example, a sensor 14 may be used to measure a speed of paper moving through the finisher apparatus, and if the sensor signal indicates that the measured speed has dropped below a threshold speed before completion of the print job, then the sensor signal can be taken as an indication of a paper jam in the finisher apparatus. In another example, a sensor 14 may be positioned to detect the presence of print media at a particular location in the finisher apparatus, and a signal from such a sensor 14 at a particular time or for a particular duration may be taken as indicative of jammed print media.

Figure 2:
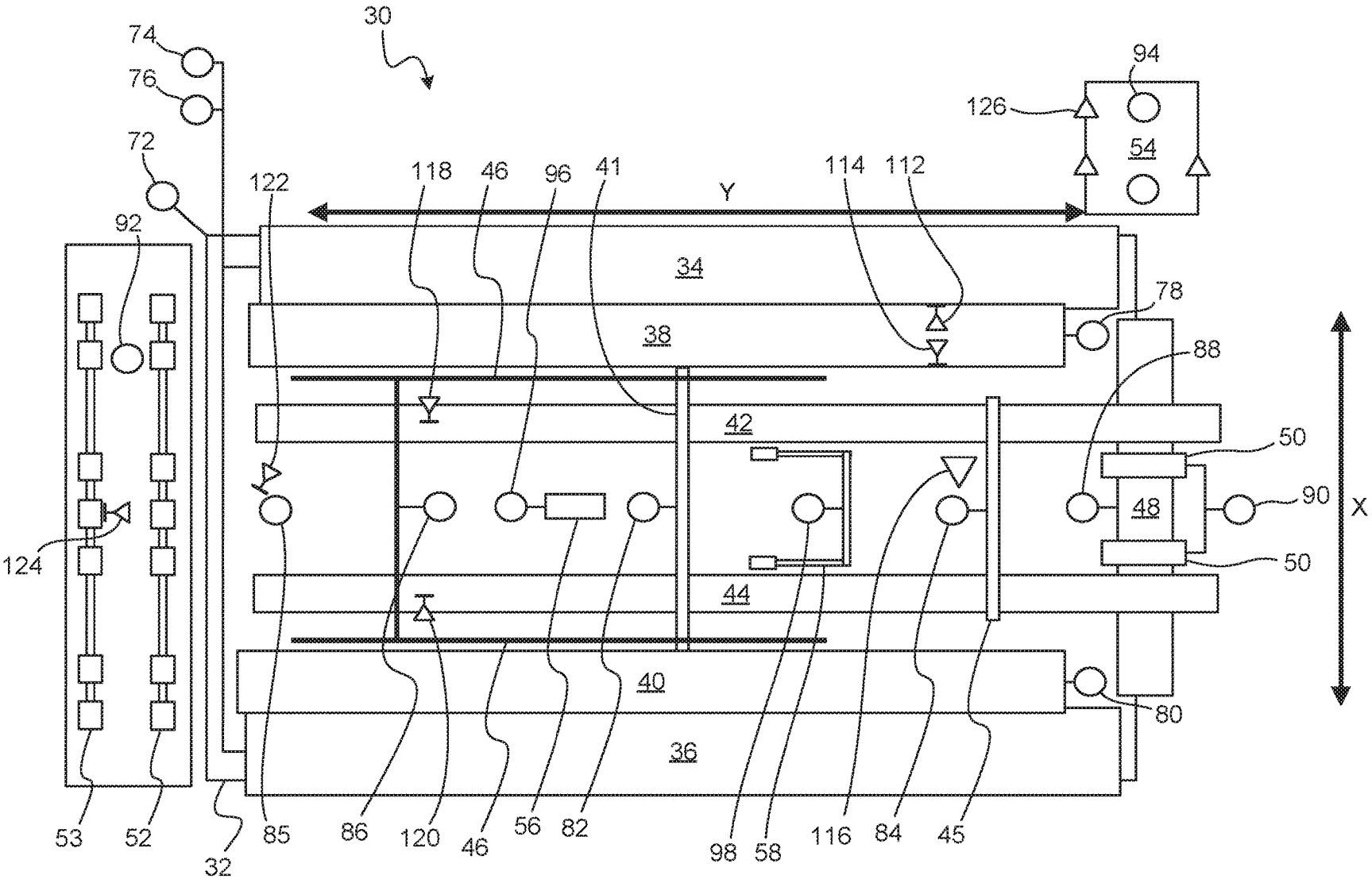
FIG. 2 is a schematic top view of an example finisher apparatus.
Figure 3:
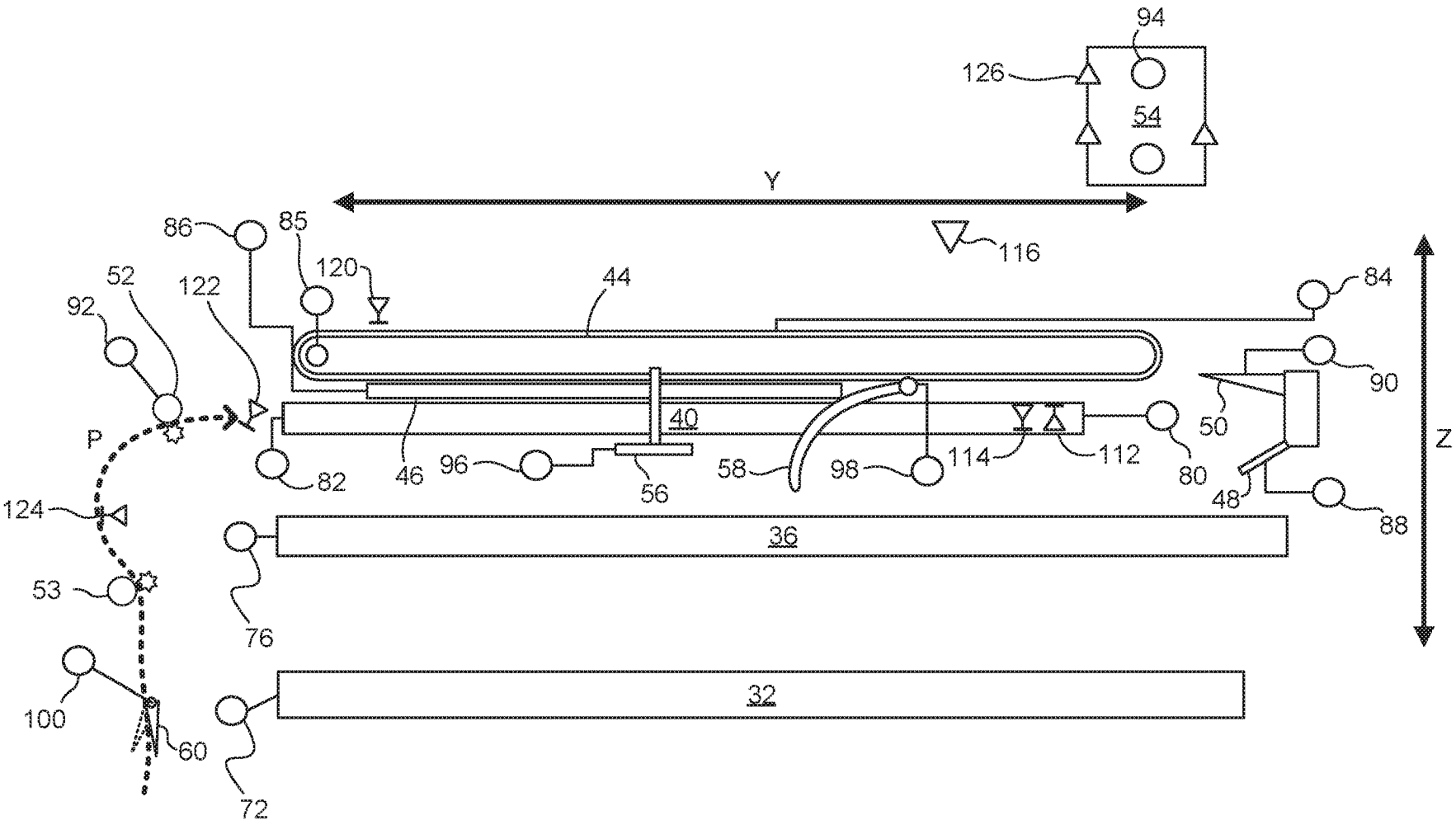
FIG. 3 is a schematic side view of an example finisher apparatus.

FIGS. 2 and 3 show an example finisher apparatus 30. An example print-medium path P is shown in FIG. 3.

The finisher apparatus 30 may include a floor 32, a rear mezzanine 34, a front mezzanine 36, a rear channel 38, a front channel 40, a channel lift mechanism 41, a rear puller 42, a front puller 44, an X-axis registration mechanism 45, edge clamps 46 (also termed bar clamps), a shelf 48, leading edge clamps 50, eject pinch rollers 52, spur pinch rollers 53, a stapler 54, an end-of-sheet clamp 56, a trailing edge clamp 58, a diverter 60, and similar. The pullers 42, 44 may be attached to a belt to provide for movement of a print medium.

The finisher apparatus 30 may further include actuators, such as motors, to actuate the components. The finisher apparatus 30 may include a floor motor 72, mezzanine motors 74, 76, a rear channel X-axis motor 78, a front channel X-axis motor 80, channel lift motor 82, a puller X-axis registration motor 84, a puller motor 85, an edge clamp motor 86, a shelf motor 88, a leading edge clamp motor 90, an eject pinch roller motor 92, a stapler motor 94, an end-of-sheet clamp motor 96, a trailing edge clamp motor 98, a diverter motor 100, and similar.

The actuators may control linear and rotational movement and positioning of various components of the finisher apparatus 30 along or about X, Y, and Z axes. For example, the stapler 54 may be actuated to move on the Y axis, the channels 38, 40 may be actuated to move on the X and Z axes, the mezzanines 34, 36 may be actuated to move on the X axis, the floor 32 may be actuated to move in on the X and Y axes, the leading edge clamps 50 may be actuated to move along the Z axis, the shelf 48 may be actuated to rotate about the X axis, and a top plate service assembly formed of the pullers 42, 44, channels 38, 40, and edge clamps 46 may be actuated to move along the X axis. Actuation of the various components of the finisher apparatus 30 realizes the finishing operations provided by the finisher apparatus 30.

The finisher apparatus 30 may further include sensors. The finisher apparatus 30 may include a channel mezzanine sensor 112, a channel X-axis registration sensor 114, a bin full sensor 116, a rear puller home sensor 118, a front puller home sensor 120, a puller entry sensor 122, an eject sensor 124, stapler sensors 126, such as a stapler motor home sensor, a low staples sensor, an out-of-staples sensor, a stapler carriage door sensor, and a media edge sensor, and similar. The sensors may be used to realize the finishing operations provided by the finisher apparatus 30.

In an example operation, a document stack or copy may be assembled on the mezzanines 34, 36. After a sheet of print media is registered, the sheet may be clamped to the mezzanines 34, 36. When accumulation of the copy is complete, the mezzanines 34, 36 may transport the stack to the stapler 54 for stapling. After the copy is stapled, the mezzanines 34, 36 may transport the finished copy to a drop position. The copy may be clamped by the leading edge clamps 50 and both mezzanines 34, 36 may be moved outwards away from the copy, dropping it onto the output floor 32. The channels 38, 40 may act as paper guide surfaces for the transport of a sheet by the pullers 42, 44. The channel X-axis registration sensor 114 may be used to establish X-axis alignment of each sheet during the accumulation of a stack. The pullers 42, 44 may grip the leading edge of each sheet and pull the sheet to X and Y alignment positions. The edge clamps 46 may be moved along the X-axis on the edge of a sheet to control sheet curl, and may be moved to specific locations based on sheet size and orientation.

A signal from a sensor, or several signals from several sensors, may be used to determine that a jam has occurred and may be used to determine the location of the jam in the finisher apparatus 30.

Figure 4:
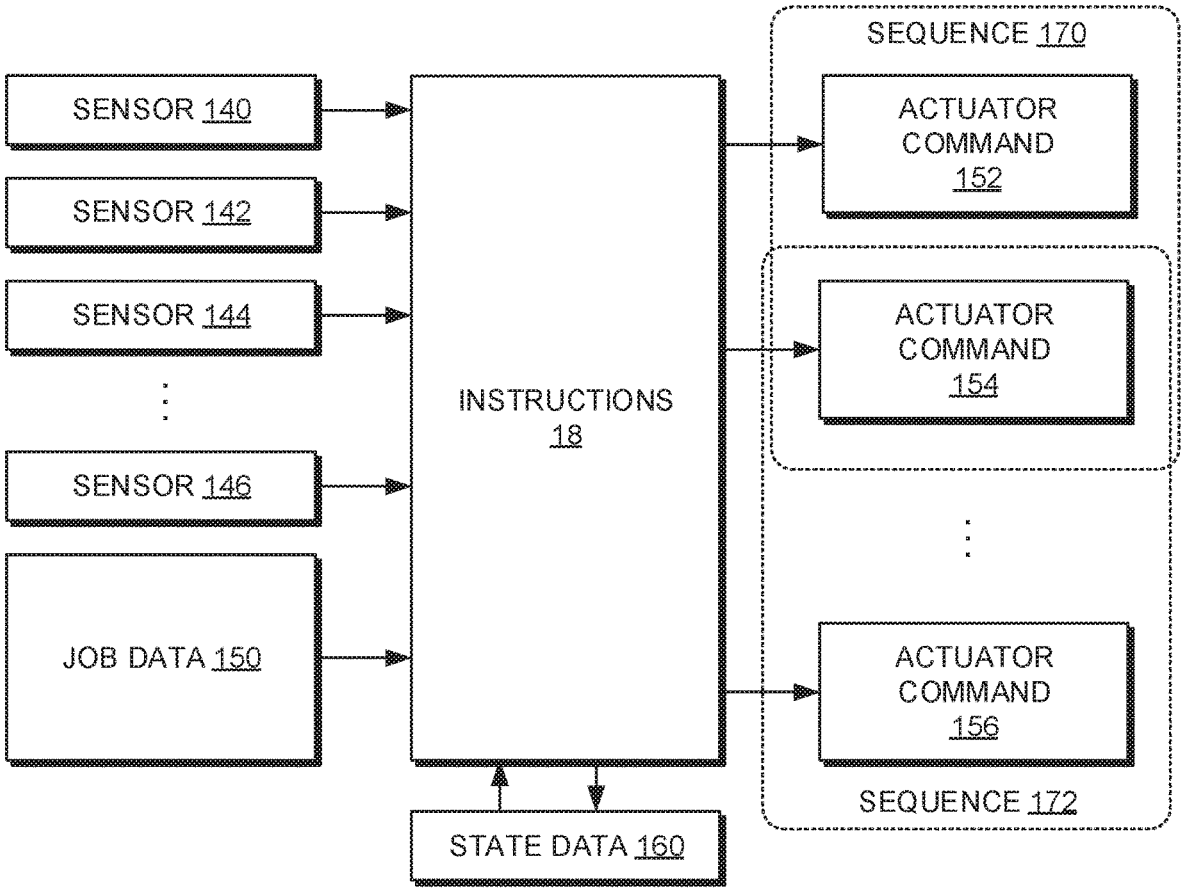
FIG. 4 is a diagram of example instructions.

FIG. 4 shows example instructions 18 to control finisher actuators based on sensor signals. The instructions 18 may take, as input, signals from a plurality of sensors 140-146, such as sensors discussed elsewhere herein. A signal or signals may be used to determine a position of a print medium within the finisher and thereby determine a location of jammed print media.

The instructions 18 may also take, as input, data 150 of the print job, such as whether a sheet or stack is being processed, a media size (e.g., letter, A4, legal, etc.), whether stapling is required, and similar, Sensor signals and print job data may reflect the performance of a finishing operation or operations, whether underway or completed. For example, a sensor signal may indicate that a stack has been stapled. In another example, a sensor signal may indicate that a stack is presently being offset.

The instructions 18 are to process the input to obtain an actuator command or commands 152-156 to automatically eject jammed print media from the print-medium path.

The instructions 18 may be to issue different sequences 170, 172 of actuator commands based on different combinations of sensor signals. A plurality of different sequences 170, 172 may be predetermined and stored, and the instructions 18 may reference sensor input to select a sequence 170, 172 that is to be executed. A sequence 170, 172 of actuator commands 152-156 may be time dependent, in that a given actuator command is executed before or after another actuator command is executed.

The instructions 18 may store state data 160 regarding the state of a jam. The state data 160 may indicate whether an actuator command 152-156 has been issued in an attempt to automatically clear the jam. The instructions 18 may reference the state data 160 when processing a sensor signal to determine an actuator command 152-156 that is to be issued. The instructions 18 may reference the state data 160 to attempt a particular sequence 170, 172 if a previous sequence 170, 172 was unsuccessful in clearing the jam. The state data 160 may represent a workflow of sequences 170, 172 of actuator commands 152-156 to issue to automatically clear a jam.

An actuator command 152-156 may be used to position a finisher component to provide user access to the print-medium path to allow manual removal of a jammed print medium. A sequence 170, 172 of actuator commands 152-156 may position several components to facilitate manual removal. A sequence 170, 172 that positions finisher components to facilitate manual removal may be the same as a sequence 170, 172 to eject the jammed print medium. That is, one sequence 170, 172 may be used to accomplish both results. The instructions 18 execute the sequence 170, 172 and, if the jam is not automatically cleared during execution of the sequence, then the end configuration of finisher components arrived at by the sequence 170, 172 facilitates manual removal of the jammed print medium.

The instructions 18 may provide user access in response to a signal from a sensor 140-146 indicative of a failure to automatically eject the jammed print medium. That is, if a jam is still signaled after issuance of a sequence 170, 172 of actuator commands 152-156 to eject the jammed print medium, a sequence 170, 172 of actuator commands 152-156 that provides for manual access may be executed. Any number of sequences 170, 172 may be executed in order to automatically clear the jam before the manual access configuration is entered, and the state data 160 may be used to track the sequences 170, 172 attempted.

With reference to FIGS. 3 and 4, an example of a sensor signal that indicates a jam is a puller entry sensor 122 failing to detect the leading edge of a print medium by an expected time. This signal may apply to all media sizes operated on by the finisher apparatus 30. An example of a sequence of actuator commands to eject the jammed print medium and to arrive at a user access configuration that facilitates removal of the jammed print medium may include actuator commands to drop an accumulated stack of print media and actuator commands to position various finisher components. Dropping the accumulated stack may include actuator commands to control mezzanine motors 74, 76 to move mezzanines 34, 36 outwards away from each other on the X axis and to control a shelf motor 88 to open and then close a shelf 48. Actuator commands to position various finisher components may include commands to accept print media at the pullers 42, 44, move edge clamps 46 up along the Z axis, maintain current X positions of the pullers 42, 44, move channels 38, 40 outwards away from each other on the X axis, shut off a channel lift motor 82 to leave the channels 38, 40 at current positions on the Z axis, raise a trailing edge clamp 58 on the Z axis, control a floor 32 to stay in, open leading edge clamps 50, and return a stapler 54 to a home position.

An example of a sensor signal that indicates a jam is a puller entry sensor 122 detecting the leading edge of a print medium by an expected time and a channel X-axis registration sensor 114 failing to detect the leading edge of a print medium by an expected time. These signals may apply to all media sizes operated on by the finisher apparatus 30. An example of a sequence of actuator commands to eject the jammed print medium and to arrive at a user access configuration that facilitates removal of the jammed print medium may be the same as the above sequence, except that the actuator commands to position various finisher components may include a command move the pullers 42, 44 to safe positions.

Other examples of sensor signals and correlated sequences of actuator commands to eject a jammed print medium and to arrive at a user access configuration that facilitates removal of the jammed print medium are contemplated, and selection of such may depend on a finishing operation, such as accumulation of a sheet of print media, transport of a stack of sheets to a stapler, and transport of a stack to a drop position. Sequences of actuator commands may be established based on locations of jammed print media and various finishing operation that may be underway. A specific sequence may then be selected based on this information to clear the jam, if possible, and then move finishing components to safe positions that facilitate user access and protect finishing components from damage by the user in case manual clearing of the jam is needed.

Figure 5:
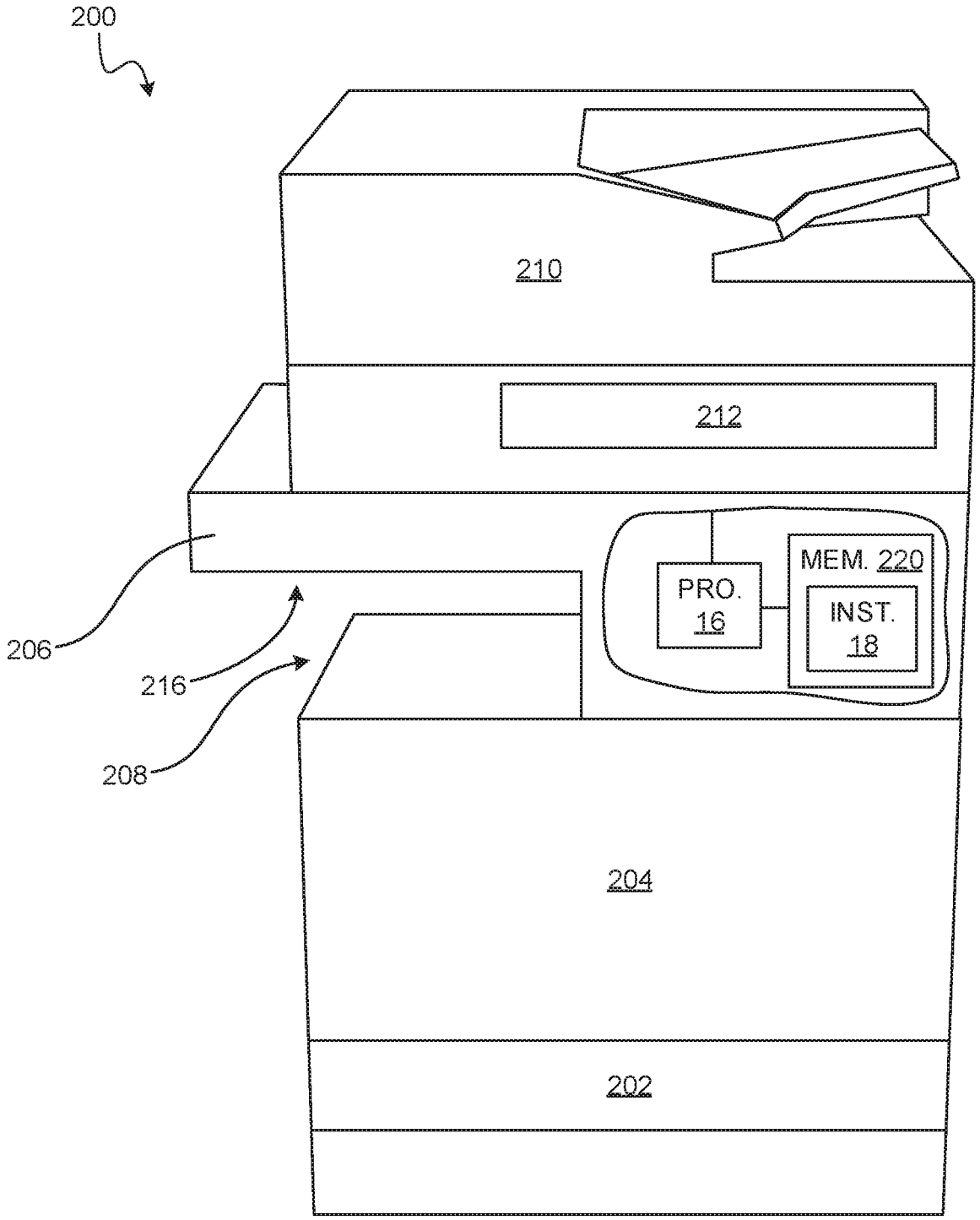
FIG. 5 is perspective diagram of an example printer.

FIG. 5 shows an example printer 200. The printer 200 may include a paper tray 202, a print engine 204, a finisher 206, an output area 208, a document feeder 210, and a user interface 212. Components 200-210 of the printer 200 may be vertically arranged in a stacked arrangement, and the finisher 206 may be positioned above the print engine 204. The printer 200 may be a multi-function device that may provide functions in addition to printing, such as scanning, copying, faxing, and the like. The printer 200 or a subcombination of its components 200-212 may be termed a printer apparatus.

The paper tray 202 may store paper or other print medium for feeding into the print engine 204. The print engine 204 may include components to print documents. The print engine 204 may provide for inkjet printing, laser printing, or similar. The finisher 206 may be coupled to an output of the print engine 204 to receive printed pages from the print engine 204. The finisher 206 may perform any number of finishing operations on printed pages that flow along a print-medium path within the finisher 206. The finisher 206 may output documents to the output area 208 for retrieval by a user. The output area 208 may include a tray or floor at a lower end of the finisher 206 or below the finisher 206. The feeder 210 may be used to receive pages of documents into the printer 200. An image capture device may be integrated with the feeder 210. A window, which may be a glass platen, may be situated below the feeder 210 to allow for capture of images of documents provided to the feeder 210. The user interface 212 may include a keyboard, touchscreen, display device, and similar device to receive input from the user to control the printer 200 and to output information to a user in human-perceptible form, such as by rendering a graphical user interface (GUI).

The printer 200 may include a processor 16 and memory 220 coupled to the processor 16. The processor 16 and memory 220 may cooperate to execute instructions 18 that may be stored in the memory 220. The processor 16 may be coupled to the user interface 212 to receive input from the user and provide information to the user. The processor 16 may be coupled to the finisher 206 to control operations of the finisher 206. The processor 16 may further be coupled to the print engine 204 and other components of the printer 200 to control same.

The memory 220 may include a non-transitory machine-readable storage medium that may be any electronic, magnetic, optical, or other physical storage device that stores executable instructions. The machine-readable storage medium may include, for example, random access memory (RAM), read-only memory (ROM), electrically-erasable programmable read-only memory (EEPROM), flash memory, a storage drive, an optical disc, and the like. The machine-readable storage medium may be encoded with executable instructions.

The finisher 206 may further include a drive mechanism, which may include pinch rollers, to convey print media through the finisher 206 along the print-medium path. The finisher 206 may provide a plurality of different print-medium paths, depending on the finishing operations performed for a given print job.

The finisher 206 may further include a plurality of actuators to actuate a plurality of components to perform any number of finishing operations on the print medium. An actuator may be coupled to the processor 16 to allow the processor 16 to control the relevant component according to the instructions 18. Any type and number of actuators and finisher components, such as those described elsewhere herein, may be provided.

The processor 16 is to execute the instructions 18 to actuate the plurality of actuators to eject print medium in response to a signal from the finisher 206 indicative of a jam of the print medium in the finisher 206. Such a signal may be generated by a sensor in the finisher 206. Any type and number of sensors, such as those described elsewhere herein, may be provided.

The compact size, shape, and stacked arrangement of the finisher 206 may make it difficult to manually clear jammed print media. Moreover, the finisher 206 may omit media access doors for clearing jams. If print media jammed in the finisher 206 cannot be accessed through the print engine 204, then access may only be available through the bottom of an accumulation area, shown at 216.

Figure 6:
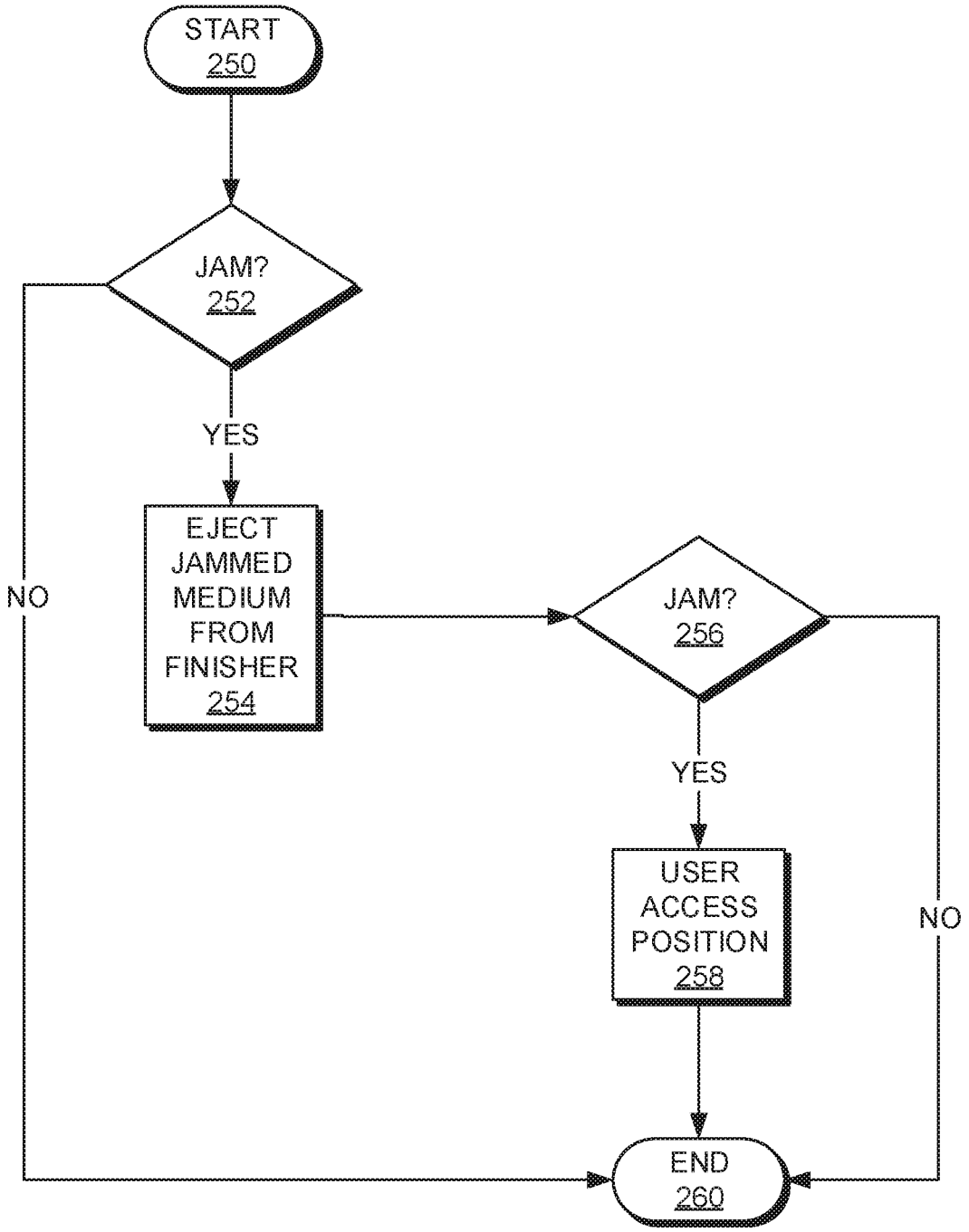
FIG. 6 is a flowchart of an example method of ejecting jammed print medium from an example finisher apparatus.

FIG. 6 shows a method to eject jammed print media from a finisher apparatus, such as any of the finisher apparatuses discussed herein. The method starts at block 250, which may include referencing a signal of a sensor in the finisher apparatus to determine whether print medium is jammed in the finisher apparatus. If jammed print medium is detected, at block 252, an actuated component of the finisher apparatus may be controlled, at block 254, to automatically eject jammed print medium from the print-medium path. This may clear the jam, with no further action being required. Examples of actuators and components, and controlling same, are discussed elsewhere herein.

Control of the actuated component to eject the jammed print medium may be automatically performed, without user input, in response to detecting the jam.

A finisher apparatus may have a plurality of actuated components. As such, block 254 may include controlling the actuated components according to a sequence to eject the print medium from the print-medium path. The sequence may be selected from several predetermined sequences. The sequence may be selected based on performance of finishing operations at the finisher apparatus. Performance may be measured by a sensor in the print-medium path, where a sensor signal may indicate that performance of a finishing operation has not started, is underway, or has completed.

If ejection of the jammed print medium fails, as determined at block 256, the actuated component may be positioned to provide user access to the print-medium path, at block 258, in response. This may allow manual removal of the jammed print medium by the user. The user-access position may be a final position of the actuation to eject the jammed medium. That is, block 254 may be an actuation that attempts to eject the jammed print medium and that ends at a position, of block 258, that provides sufficient space for the user to access the print medium should it not have been ejected. In such example, the check at block 256 may determine that the user-access position be maintained until the jam is cleared manually.

The method ends at block 260, with a jam having been cleared automatically or the actuated component stopping at a position that provides sufficient clearance for the user to manually clear the jam.

Figure 7:
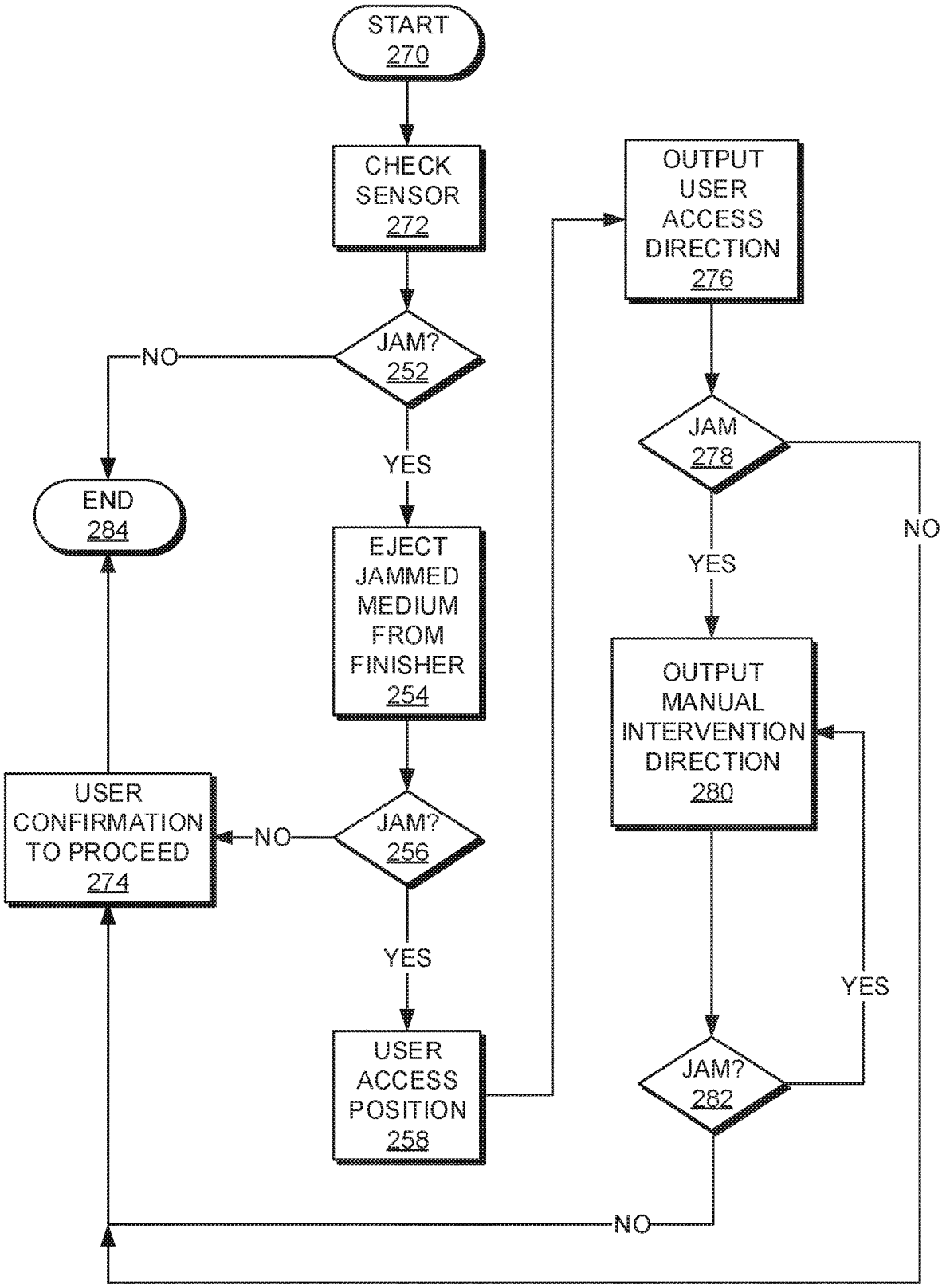
FIG. 7 is a flowchart of another example method of ejecting jammed print medium from an example finisher apparatus

FIG. 7 shows another method to eject jammed print media from a finisher apparatus, such as any of the finisher apparatuses discussed herein.

The method starts at block 270. At block 272, a signal of a sensor in the finisher apparatus may be checked to determine whether print medium is jammed in the finisher apparatus. If jammed print medium is detected, at block 252, an actuated component of the finisher apparatus may be controlled, at block 254, to automatically eject jammed print medium from the print-medium path.

If the jam is automatically cleared, the user may be prompted for confirmation, at block 274. Confirmation may include presenting information at a user interface and directing the user to visually confirm that the jam has been cleared. Confirmation may include prompting the user to continue the print job.

If ejection of the jammed print medium fails, as determined at block 256, the actuated component may be positioned to provide user access to the print-medium path, at block 258, in response. User access direction may be outputted to the user at a user interface, at block 276. User access direction may include information to the user to assist in clearing the jammed print medium, such as by accessing an accumulation area of the finisher apparatus and physically removing the jammed print medium from the finisher apparatus.

If a jam remains detected, at block 278, then manual intervention direction may be outputted to the user at a user interface, at block 280. Manual intervention direction may include steps for the user to follow to physically manipulate an actuated component. The finisher apparatus may stay at this state, via block 282, until the jam is cleared.

The method ends at block 284, with a jam having been cleared automatically or with user assistance.

The techniques described herein may allow for effective clearing of jammed print media in a finisher. This may provide for an improved user experience by partially of completely relieving the user of the need to clear a jam. The finisher may also be less likely to be damaged by the user. Printer uptime may also be increased.

It should be recognized that features and aspects of the various examples provided above can be combined into further examples that also fall within the scope of the present disclosure. In addition, the figures are not to scale and may have size and shape exaggerated for illustrative purposes.

The invention claimed is:

1. A finisher apparatus comprising:

a plurality of actuators to control a respective plurality of components of the finisher apparatus to move along a print-medium path and perform a respective plurality of finishing operation on a print medium;

a sensor to sense the print medium in the print-medium path in the finisher apparatus; and a processor coupled to the actuator and the sensor, the processor to execute instructions, the instructions to actuate the plurality of actuators in a sequence to move each of the respective plurality of components to at least one respective ejection position to automatically eject the print medium from the print-medium path in response to a signal from the sensor indicative of a jam of the print medium in the finisher apparatus, wherein a respective end configuration of each of the plurality of components after actuating the plurality of actuators to automatically eject the print medium is a respective safe position along the print-medium path to facilitate manual removal of the jam of the print medium.

2. The apparatus of claim 1, wherein the instructions are to determine the sequence based on performance of the plurality of finishing operations.

3. The apparatus of claim 1, comprising a plurality of sensors, including the sensor, wherein the instructions are to select the sequence from a plurality of different selectable sequences in response to a signal from the plurality of sensors.

4. A printer apparatus comprising:

a print engine to print to a print medium;

a finisher coupled to the print engine, the finisher including a plurality of actuators to control a plurality of components to move along a print-medium path and perform a finishing operation on the print medium; and a processor coupled to the finisher, the processor to execute instructions, the instructions to actuate the plurality of actuators in a sequence to move each of the plurality of components to at least one respective ejection position to automatically eject the print medium in response to a signal from the finisher indicative of a jam of the print medium in the finisher, wherein an end configuration of the component after actuating the actuator to automatically eject the print medium is a respective safe position along the print-medium path to facilitate manual removal of the jam of the print medium.

5. The apparatus of claim 4, wherein the instructions are further to actuate the plurality of actuators to position the plurality of components to provide user access into the finisher.

6. The apparatus of claim 5, wherein the instructions are further to actuate the plurality of actuators to position the plurality of components to provide the user access in response to a signal from the finisher indicative of a failure to eject the print medium from the finisher.

7. The apparatus of claim 4, wherein the instructions are to select the sequence from a plurality of different selectable sequences.

8. A method comprising:

detecting a jam of a print medium in a finisher apparatus, the finisher apparatus having a plurality of actuated components movable along a print-medium path, the actuated components to perform respective finishing operations on a print medium; and controlling the plurality of actuated components according to a sequence to move to at least one ejection position to automatically eject jammed print medium from the print-medium path, wherein an end configuration of the actuated component is a safe position along the print-medium path to provide user access to the print-medium path to allow manual removal of the jammed print medium.

9. The method of claim 8, wherein controlling the actuated component to eject the jammed print medium from the print-medium path is performed in response to the detecting of the jam of the print medium in the finisher apparatus.

10. The method of claim 8, wherein comprising controlling a plurality of actuated components is in response to the detecting of the jam of the print medium in the finisher apparatus.

11. The method of claim 8, further comprising selecting the sequence from a plurality of different sequences according to performance of a plurality of finishing operations at the finisher apparatus.

12. The apparatus of claim 1, wherein the instructions are further to actuate the plurality of actuators in a further sequence to eject the print medium from the print-medium path in response to detecting a failure to eject the jammed print medium from the print-medium path after the sequence.

13. The apparatus of claim 1, wherein the processor is to control the actuator to resume a subsequent finishing operation in response to a signal from the sensor indicative that the jam was automatically ejected.

* * * * *